United States Patent [19]

Heath

[11] Patent Number: 4,692,572

[45] Date of Patent: Sep. 8, 1987

[54] OVER-CENTER ACTUATOR SWITCH

[75] Inventor: James G. Heath, Mount Prospect, Ill.

[73] Assignee: Illinois Tool Works Inc., Chicago, Ill.

[21] Appl. No.: 827,896

[22] Filed: Feb. 10, 1986

[51] Int. Cl.[4] ..... H01H 5/00

[52] U.S. Cl. ..... 200/17 R; 200/67 A

[58] Field of Search ..... 200/17 R, 17 A, 17 B, 200/153 T, 76, 67 A, 18

[56] References Cited

U.S. PATENT DOCUMENTS 3,277,264 10/1966 Barthell ..... 200/153 T 3,311,723 3/1967 Stevens ..... 200/67 A

*Primary Examiner*—A. D. Pellinen

*Assistant Examiner*—Morris Ginsburg

*Attorney, Agent, or Firm*—D. D. Mondul; T. W. Buckman

[57] ABSTRACT

An over-center actuator switch assembly includes a U-shaped bracket having a plurality of similar switches mounted in side-by-side relation between the flanges of the bracket. Each actuator has a depressible operator extending into the bracket. An operating lever is pivoted between the bracket flanges and contacts all of the switch operators. A control lever is also pivoted between the side flanges of the bracket, and one or more compression springs is biased between the levers. Pivotal movement of the control lever moves the levers and springs through an over-center condition to effect snap action pivoting of the switch operating lever and reversal of the condition of depression of the operating members.

19 Claims, 5 Drawing Figures

OVER-CENTER ACTUATOR SWITCH

BACKGROUND OF THE INVENTION

It is often necessary or desirable to mount a plurality of electric switches adjacent to one another for conjoint operation by a common actuator. The various switches to be actuated or operated may be of the same general external dimensions, but have different operational qualities. Thus, one switch may require greater or lesser force to operate it than another switch. Such difference in operating characteristics must not be allowed to cause undesirable interaction among the various switches. Furthermore, the number of switches to be actuated or operated by a common actuator may vary in number.

OBJECTS AND SUMMARY OF THE PRESENT INVENTION

It is an object of the present invention to provide an assembly of a plurality of externally-like switches operated in common by a single switch operator.

More particularly, it is an object of the present invention to provide such an assembly of switches in which the operator is an over-center type operator.

In accordance with the principles of the present invention a plurality of externally-like switches is mounted in a bracket. The switches may vary in number and in internal construction. Each switch has a depressible switch operator with all of the switch operators arranged in parallel along a straight line. Each switch operator may acquire the same force for depression, or different operators may differ in such requirement. Fixed switch contacts extend from the switches in the opposite direction from the operators for connection to external circuits. The number of switches in the bracket may vary from one switch assembly to another.

A pair of levers is mounted in the bracket, respectively being pivoted. An external switch actuator operates on the first lever which operates through a pair of compression springs the second lever in an over-center type actuation whereby the second lever simultaneously depresses or releases all of the switch operators simultaneously.

THE DRAWINGS

The present invention will best be understood with reference to the following specification when taken in connection with the accompanying drawings wherein.

DETAILED DISCLOSURE OF THE ILLUSTRATED EMBODIMENT

Figure 1:
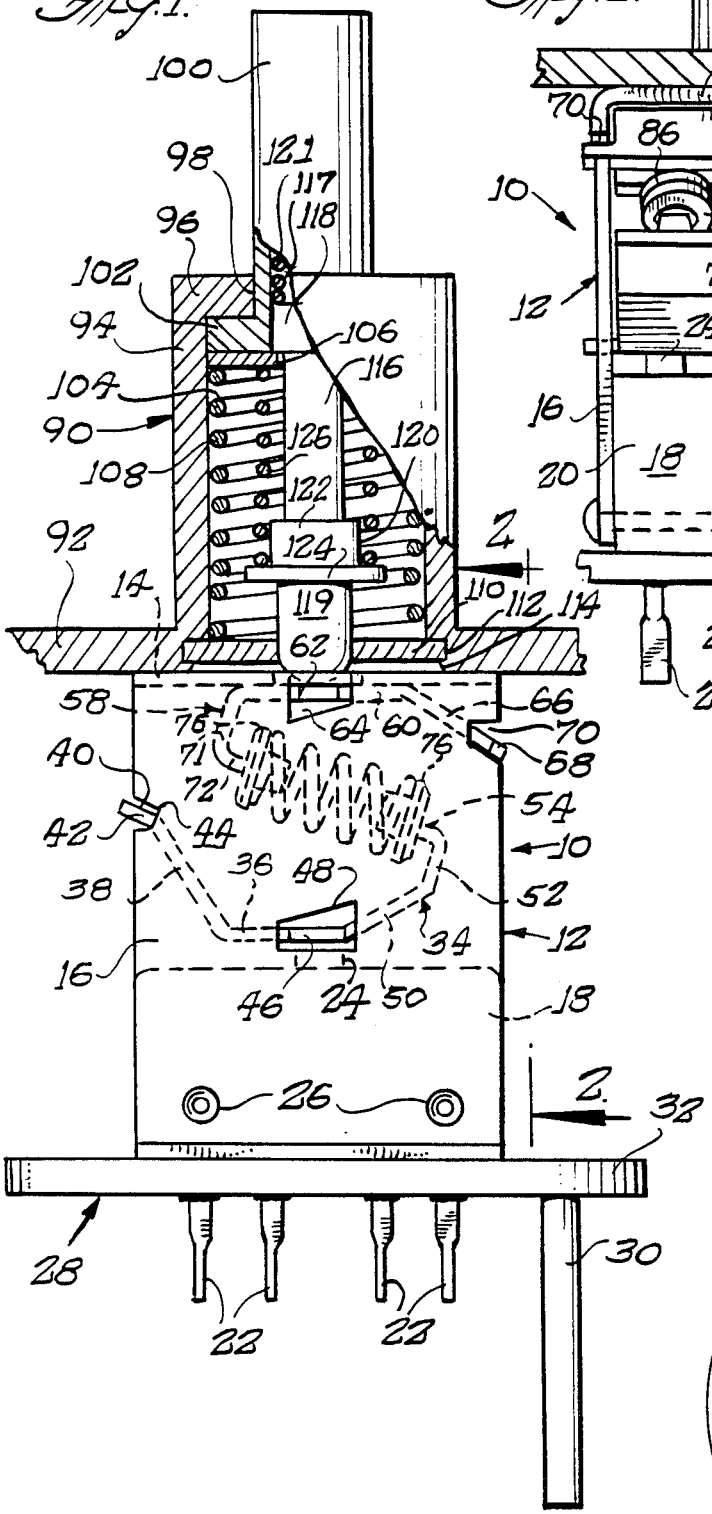
FIG. 1 is a side elevational view of an over-center actuator switch assembly constructed in accordance with the principles of the present invention, partly being broken away for illustrative purposes.
Figure 2:
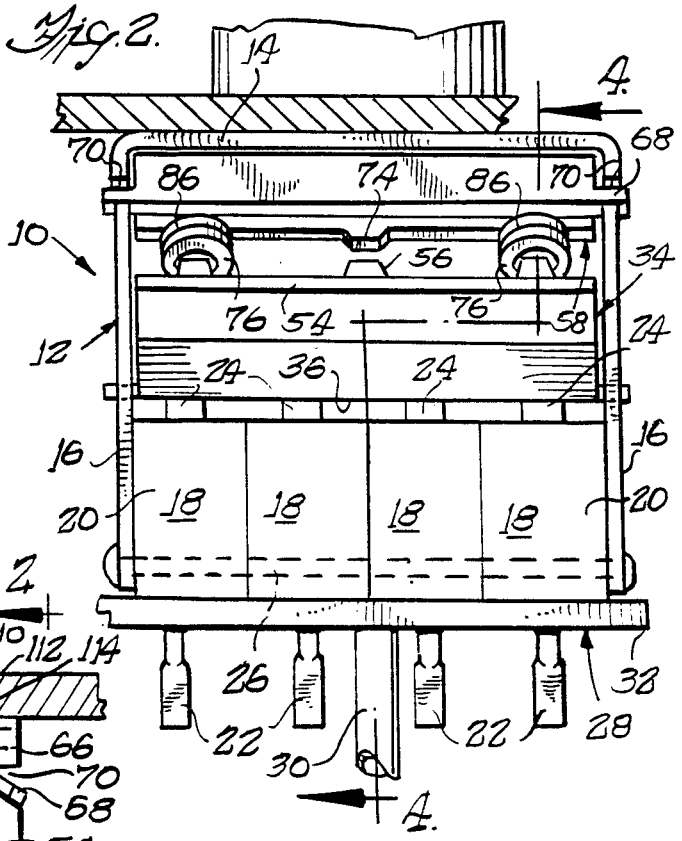
FIG. 2 is a front elevational view from the right side of FIG. 1 as taken along the line 2—2.
Figure 3:
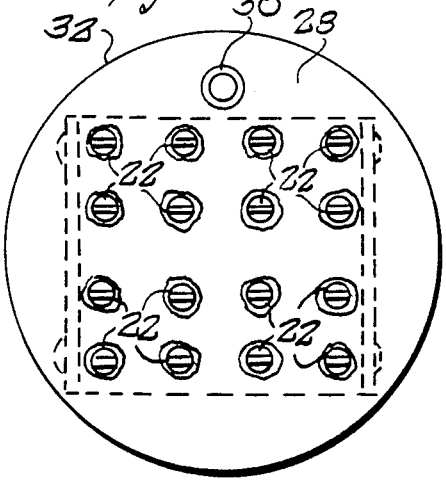
FIG. 3 is a bottom view of the assembly in FIG. 1.
Figure 4:
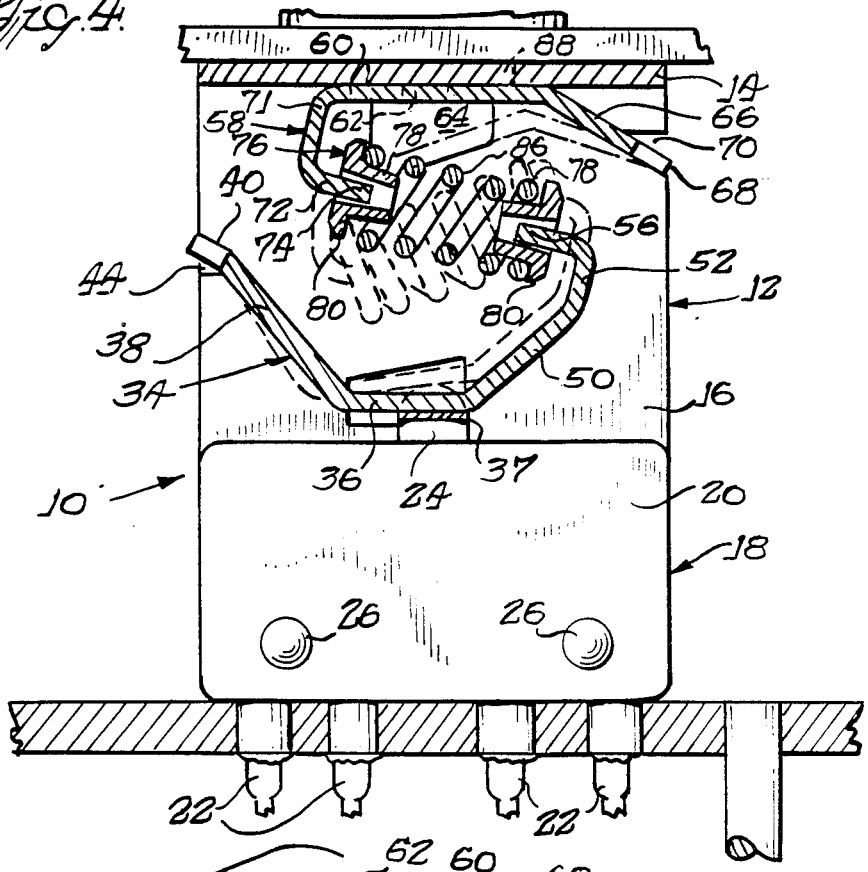
FIG. 4 is a vertical sectional view taken substantially along the line 4—4 in FIG. 2.

Turning now in greater particularity to the drawings, and first to FIGS. 1, 2 and 4, there will be seen an over-center actuator switch assembly 10 including a U-shaped base or bracket 12 shown in inverted position. The bracket includes a central web 14 and a pair of sidewalls or flanges 16 parallel to one another and perpendicular to the web 14 with which they are formed integrally. The bracket preferably is stamped from sheet steel.

A plurality of similar switches 18 is disposed between the flanges 16 adjacent the outer ends thereof. By way of example but not necessarily limited thereto, each switch may comprise a T-16 basic switch sold by ITW Switches, an Illinois Tool Works company. Each such switch 18 includes a rectangular body 20 having four spaced terminals 22 extending from the lower edge thereof. Each switch further has an upwardly projecting actuator 24. Four switches 18 are shown mounted between the flanges 16 by a pair of rivets 26 extending through the flanges 16 and through the bodies 20 of the switches 18. If all of the switches 18 are identical, then the force needed to depress each plunger or actuator 24 is the same. However, it is contemplated that switches which are externally of similar size could be mounted as disclosed, but with different internal construction, whereby different actuators might have different resistances to movement. It is also contemplated that one or more switches could be omitted with substitution of a like number of spacers.

A glass or other ceramic disc 28 is disposed adjacent the lower edges of the switches 18. The contacts 22 extend through the glass disc 28 and are fused thereto. An extending tubular member 30 is also fused to the glass disc and extends therefrom beyond the terminals 22. A metal band 32 encircles the glass disc and provides protection therefor.

Figure 5:
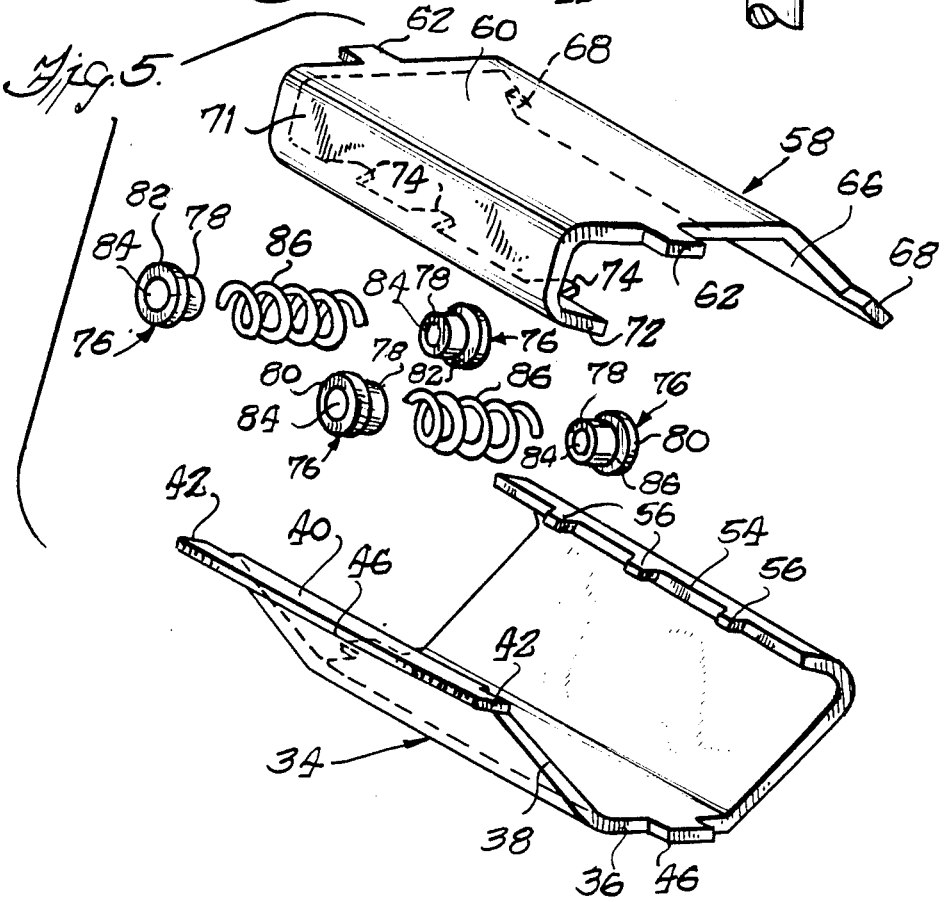
FIG. 5 is an exploded perspective view of the over-centering levers and springs.

A switch contacting operated or second lever 34 is disposed between the flanges 16 of the bracket 12 and for the most part is spaced slightly therefrom. The lever 34 is preferably stamped from steel, and like the bracket 12 and another lever to be referred to hereinafter is preferably formed of stainless steel. The lever 34 includes a generally horizontal center section 36 which engages the switch actuators 24, either directly, or through a spacer strip 37 as shown in FIG. 4. The spacer strip may extend the entire width of the center section 36 of the lever 34, or it may only extend over a portion of the center section 36. In such manner, the spacer strip 37 may engage any selective member of the switch actuators 24. The spacer strip 37 is employed to ensure that each switch actuator 24 is biased to operate substantially about the make-break point of it respective switch 18. A connecting arm 38 extends diagonally upward to the left (FIGS. 1, 4 and 5) to an edge flange 40 which is deflected toward the horizontal. The edge flange 40 is provided at its opposite ends with outwardly extending tabs 42 which are received in notches 44 in the left edges (as viewed in FIGS. 1 and 4) of the bracket flanges 16 for pivotal mounting of the lever 34. The center section 36 of the lever 34 is provided with outwardly extending tabs 46 extending into shaped apertures 48 of the flanges 16 to limit pivotal movement of the lever 34.

An operating arm 50 of the lever 34 extends diagonally upwardly from the right edge of the center section 36 to a more nearly vertical flange 52 which is provided at its upper extremity with a right-angle flange 54 having a plurality of spring anchor tabs 56 projecting from the edge thereof. Three such tabs are shown by way of example, but the number may be more or less.

The switch assembly further includes a first or control or operating lever 58 somewhat similar to, but specifically different from the second lever 34 hetetofore described. The first lever 58 includes a flat body portion 60 of rectangular outline extending nearly from one side flange 16 to the other of the bracket 12. Aligned tabs 62 extend from the opposite extremities of the body portion 60 and are received in shaped apertures 64 in the flanges 16 for limiting pivotal movement of the lever 58 as will be brought out hereinafter. A flange 66 angles downwardly to the right (FIGS. 1, 4 and 5) from the right edge of the body portion 60 and is provided at its far corners with tabs 68 which are received in edge opening recesses 70 of the flanges 16 for pivotally mounting the lever 58.

At the left edge of the body portion 60 there is a flange 71 depending at an obtuse angle to the body portion and of restricted height. A right-angle flange 72 extends from the bottom edge of the flange 71 and is provided with spring anchor tabs 74 extending from and parallel to the flange 72 and in alignment with the spring anchor tabs 56 of the second lever 34. The lever 58 preferably comprises an integral sheet metal stamping which like the second lever and the bracket preferably is formed of stainless steel.

A plurality of spring guides or seats 76 is provided, each having a tubular externally tapered stem 78 and a radially enlarged head 80 providing a spring seat or shoulder 82 beneath the head and about the tubular stem. Each spring guide is provided with an axial through-bore 84.

In the illustrative example there are four spring guides 76 mounted in aligned pairs on the tabs 56 and 74. Compression springs 86, preferably made of stainless steel, extend respectively between the aligned pairs of spring guides 76 and are dimensioned so as normally to be compressed. The reactive forces hold the body portion 60 of the first lever 58 normally up against the underside of the web 14 and hold the second lever 34 pivoted to its lowermost position, maintaining the several operating members 24 in depressed position.

The web 14 is provided with a central aperture 88 through which a member may press down to pivot the first lever 58 downwardly about the tabs 68 and slots 70. As is shown in broken lines in FIG. 4 such pivoting movement causes the springs 86 to move through a dead center or toggling position, thereafter exerting an upward force on the spring anchor tabs 56 and flange 54 of the second lever 34, whereby to pivot this lever upwardly about the tabs 42 and slots 44 to the broken line position of FIG. 4, thereby allowing the switch operators 24 to rise on their own internal spring pressure. Release of downward pressure on the body portion 60 of the first lever 58 causes this lever to rise to its full up position under the compressive force of the springs 86. This in turn forces the second lever 34 down to depress the switch operators 24 again.

One suitable form of switch operator 90 for the switch assembly is shown in FIG. 1 and includes a housing 92, shown fragmentarily only, in which the switch assembly 10 is mounted by any suitable means. An upstanding cylinder 94 is formed integral with or is otherwise suitably secured to the housing 92 and is provided with a transverse top wall 96 having a central aperture 98. A cylindrical plunger 100 upstands through the aperture 98 and is provided with an enlarged head 102 received beneath the transverse wall 96 and within the internal bore 104 of the cylinder 94. A disc or washer 106 lies beneath the head 102, and a return spring 108 is compressed between the washer 106 and a disc-shaped spring base 110 received in an enlargement 112 at the base of the cylindrical bore 104 and staked in place at 114. The cylinder plunger 100 may be manually or mechanically, or hydraulically or electrically, or otherwise depressed against the force of the spring 108 which normally holds the plunger 100 in the raised position shown.

An elongated piston 116 has an enlarged cylindrical head 118 received in a cylindrical bore 117 of the plunger 100. A compression spring 121 in the bore 117 presses down on the head 118 and normally holds the piston 116 down with the head 118 bearing against the disc or washer 106. The lower end of the piston is rounded at 119 and extends through the hole or opening 88 in the web 14 to bear against the body portion 60 of the first lever 58.

A spring anchor 120 is fixed on the piston 116 upwardly from the rounded lower end 119 and includes a sleeve 122 secured to the piston in any suitable manner and having at its lower edge a circumferential outwardly extending flange 124. A compression spring 126 at its upper end engages the washer 106 and at its lower end is centered by the sleeve 122 and bears against the flange 124.

When the plunger 100 is depressed the springs 121 and 126 lower the piston 116 to cause operation of the switch assembly. However, even if the plunger 100 is depressed farther than it should be with regard to the switch assembly no damage will result to the switch assembly, since the springs 121 and 126 will allow the head 118 of the piston 116 to move upwardly within the plunger 100. Upon release of the plunger 100 it is returned to its upper position as illustrated by the spring 108, and the springs 121 and 126 allow the plunger and the piston 116 to assume their initial relative positions as shown in FIG. 1.

The employment of springs 108, 121, 126 is designed to provide flexibility to meet various travel-before-actuation requirements and various actuating force requirements by merely substituting different spring components, not requiring any piece-part changes. In such manner, the switch assembly 10 may be economically able to meet a wide range of operating parameter requirements.

In response to movement of the plunger 100, spring 121 and spring 126 additively apply force to move the piston 116. Spring 109 provides return bias to the plunger 100.

The movement of the piston 116 could be effected using only springs 108 and 121. However, by providing spring 126, the total force applied to the piston 116 is the sum of the forces provided by springs 121 and 126. In such manner, more flexibility in determining travel-before-actuation and actuating force parameters is provided than is available with a single spring 121. Moreover, such flexibility may be accomplished with standard stock springs having standard tolerances rather than its being necessary to custom-specify a single spring to fulfill custom parameter requirements.

Thus, custom parameter requirements may be fulfilled by changing only the springs 108, 121, or 126, using stock springs rather than changing other piece-parts of the switch assembly 10 or by using more expansive custom-made springs.

The over-center actuator switch assembly as disclosed herein is capable of substantial modification in that from one to four switches 18 may be included (more with a larger bracket), and the internal switching characteristics and resistance of the plungers 24 may vary from one switch to another. All that is necessary to accommodate to such variability is a change in the number or spring rates of the springs 86. It is important to note that the springs 86 always exert a restoring force on the first lever 58 regardless of the operating position thereof, whereby this lever returns to its initial position (solid line position of FIG. 4) when downwardly depressing force is released. This ensure return of all parts to initial position when depressing force is released.

At rest position the flat center portions of the two levers are substantially parallel and are in overlapping, partially aligned relation to one another. The plunger 116 is aligned with the plane of the switch operators 24. The spring anchors are reentrant relative to the center portions of the respective levers and are directed towards one another in substantial alignment.

The advantages of over-center switch operation are well known in producing a snap action that avoids or minimizes contact burning.

The specific example of the invention as herein shown and described will be understood as being for illustrative purposes only. Various changes in structure will no doubt occur to those skilled in the art, and will be understood as forming a part of the present invention insofar as they fall within the spirit and scope of the appended claims.

The invention is claimed as follows:

1. An over-center actuator switch assembly comprising base means having a pair of spaced apart walls, switch means mounted between said walls and having depressible switch operating means, a switch operating lever, means pivotally mounting said lever from said walls and engageable with said switch operating means to depress said switch operating means, a control lever, means pivotally mounting said control lever from said walls, compression spring means bearing against said control lever and said switch operating lever and normally biasing said control lever to a rest position and said switch operating lever to switch operating means depressing position, rest position means on said base means against which said control lever bears to establish rest position for said control lever, said control lever being pivotable away from rest position in response to an actuating force with said levers and said spring means thereupon moving through over-center position to pivot said switch operating lever to move said switch operating means to non-depressed position and returning to its rest position upon removal of said actuating force.

2. A switch assembly as set forth in claim 1 wherein said switch operating lever has a substantial flat center portion engageable with said switch operating means, and said control lever has a substantially flat center portion engaging the rest position means on the base when in rest position, said center portions being substantially parallel to one another with said levers in rest position, each of said levers having spring anchor means thereon with the anchor means on one lever directed toward the anchor means on the other lever and in substantial alignment therewith when said levers are in rest position, and wherein said spring means are compressed between the spring anchor means of the control lever and the switch operating lever.

3. A switch assembly as set forth in claim 1 wherein said switch means comprises a plurality of switches mounted in side-by-side relation between said walls, each of said switches having an operating member extending therefrom, and wherein said switch operating lever engages all of said switch operating members.

4. A switch assembly as set forth in claim 2 wherein said switch means comprises a plurality of switches mounted in side-by-side relation between said walls, each of said switches having an operating member extending therefrom, and wherein said switching operating lever engages all of said switch operating members.

5. A switch assembly as set forth in claim 1 wherein each of said levers has a pair of projections extending in opposite directions therefrom, and wherein said walls are provided with recesses in which said projections are received for pivotal mounting of said levers.

6. A switch assembly as set forth in claim 3 wherein each of said levers has a pair of projections extending in opposite directions therefrom, and wherein said walls are provided with recesses in which said projections are received for pivotal mounting of said levers.

7. A switch assembly as set forth in claim 4 wherein each of said levers has a pair of projections extending in opposite directions therefrom, and wherein said walls are provided with recesses in which said projections are received for pivotal mounting of said levers.

8. An over-center actuator switch assembly comprising base means having a pair of spaced apart walls, a plurality of switches mounted between said walls and each having a depressible switch operating member, a switch operating lever, means pivotally mounting said lever from said walls with said lever engageable with said switch operating members simultaneously to move all of said switch operating members to or from depressed position, a control lever, means pivotally mounting said control lever from said walls, compression spring means bearing against said control lever and said switch operating lever and normally biasing said control lever and said switch operating lever to rest positions, said control lever being pivotable away from its rest position in response to an actuating force with said levers and said spring means thereupon moving through over-center position to pivot said switch operating lever to effect movement of said switch operating member and returning to its rest position upon removal of said actuating force.

9. A switch assembly as set forth in claim 8 wherein said switch operating lever has a substantially flat center portion engageable with said switch operating member, and said control lever has a substantially flat center portion engaging rest position means on the base when in rest position, said center portions being substantially parallel to one another with said levers having reentrant spring anchor means thereon with the anchor means on one lever directed toward the anchor means on the other lever and in substantial alignment therewith when said levers are in rest position, and wherein said spring means are compressed between the spring anchor means of the control lever and the switch operating lever.

10. A switch assembly as set forth in claim 8 wherein each of said levers has a pair of projections extending in opposite directions therefrom, and wherein said walls are provided with recesses in which said projections are received for pivotal mounting of said levers.

11. A switch assembly as set forth in claim 9 wherein each of said levers has a pair of projections extending in opposite directions therefrom, and wherein said walls are provided with recesses in which said projections are received for pivotal mounting of said levers.

12. On over-center actuator switch assembly comprising a substantially U-shaped bracket having a web and a pair of spaced, parallel flanges extending from opposite edges of said web, at least one switch having a depressible actuating member extending therefrom, means for positioning said switch at a predetermined location between said flanges, a switch operating lever, means pivotally mounting said levers from said flanges with said lever engageable with said actuating member, a control lever, means pivotally mounting said control lever from said flanges, compression spring means bearing against said control lever and said switch operating lever and normally biasing both of said levers to respective rest positions, said control lever being pivotable away from its rest position in response to an actuating force with said levers and said spring means thereupon moving through over-center position to pivot said switch operating lever to effect movement of the actuating member and returning to its respective rest position upon removal of said actuating force.

13. A switch assembly as set forth in claim 12 and further including a plurality of switches positioned between said flanges, said switch operating lever engaging the actuating members of all of said plurality of switches.

14. A switch assembly as set forth in claim 13 wherein said switches are in side-by-side relation.

15. A switch assembly as set forth in claim 12 and further including an aperture in said web affording access to said control lever for pivoting thereof.

16. An over-center actuator switch assembly comprising a base having a plurality of spaced apart walls, switch means mounted between said plurality of walls and having depressible switch operating means, a switch operating lever having a first fulcrum and a first free end, a control lever having a second fulcrum and a second free end, and compression spring means for bearing upon said first free end and said second free end effecting equal loading of said switch operating lever and said control lever; said first fulcrum being associated with a first of said plurality of walls, said second fulcrum being associated with a second of said plurality of walls, said first wall and said second wall being substantially in facing relation; said switch operating means being engageable in a depressed position by said switch operating lever intermediate said first fulcrum and said first free end; said control lever being response to a transverse actuating force applied intermediate said second fulcrum and said second free end, thereby moving said compression spring means through over-center position to pivot said switch operating lever about said first fulcrum to move said switch operating means to a non-depressed position.

17. A switch assembly as recited in claim 16 wherein said switch operating lever has a substantially flat first center portion engageable with said switch operating means, and said control lever has a substantially flat second center portion substantially parallel to said first center portion when said switch operating means are depressed; each of said switch operating lever and said control lever having spring anchor means thereon with said anchor means on one lever directed toward said anchor means on the other lever and in substantial alignment therewith when said switch operating means are depressed.

18. A switch assembly as recited in claim 16 wherein said switch means comprises a plurality of switches mounted in side-by-side relation between said walls, each of said switches having an operating member extending therefrom, and wherein said switch operating lever engages at least one of said switch operating members.

19. A switch assembly as recited in claim 17 wherein said switch means comprises a plurality of switches mounted in side-by-side relation between said walls, each of said switches having an operating member extending therefrom, and wherein said switch operating lever engages at least one of said switch operating members.

* * * * *